US006186409B1

(12) United States Patent
Srinath et al.

(10) Patent No.: US 6,186,409 B1
(45) Date of Patent: Feb. 13, 2001

(54) NOZZLES WITH INTEGRATED OR BUILT-IN FILTERS AND METHOD

(75) Inventors: Dharapuram N. Srinath, Ellicott City; Eric Koehler, Woodstock, both of MD (US)

(73) Assignee: Bowles Fluidics Corporation, Columbia, MD (US)

( * ) Notice: Under 35 U.S.C. 154(b), the term of this patent shall be extended for 0 days.

(21) Appl. No.: 09/457,316

(22) Filed: Dec. 9, 1999

Related U.S. Application Data

(60) Provisional application No. 60/111,745, filed on Dec. 10, 1998.

(51) Int. Cl.[7] ..... B05B 1/08

(52) U.S. Cl. ..... 239/1; 239/589.1; 239/101; 239/553; 239/462; 239/590; 239/600; 239/DIG. 3; 239/284.1; 137/833; 137/835; 264/250; 264/263; 264/DIG. 76

(58) Field of Search ..... 239/101, 102.1, 239/1, 11, 462, 553, 553.5, 575, 284.1, 589.1, 590, 590.5, 600, DIG. 3; 137/826, 833, 835; 264/250, 263, DIG. 76

(56) References Cited

U.S. PATENT DOCUMENTS

| | | | | |
|---|---|---|---|---|
| 3,468,323 | * | 9/1969 | Jones | 137/835 X |
| 3,557,814 | * | 1/1971 | Neradka | 137/835 X |
| 4,645,126 | * | 2/1987 | Bray, Jr. | 239/284.1 X |
| 4,662,568 | | 5/1987 | Bauer | 239/589.1 |
| 4,955,547 | | 9/1990 | Woods | 239/589.1 |
| 5,151,955 | | 9/1992 | Stouffer | 239/11 |
| 5,213,270 | | 5/1993 | Stouffer et al. | 239/589.1 |
| 5,472,143 | | 12/1995 | Bartels et al. | 239/462 |
| 5,524,660 | * | 6/1996 | Dugan | 137/833 X |
| 5,749,525 | * | 5/1998 | Stouffer | 239/284.1 |

* cited by examiner

*Primary Examiner*—Andres Kashnikow
*Assistant Examiner*—Steven J. Ganey
(74) *Attorney, Agent, or Firm*—Jim Zegeer

(57) ABSTRACT

A molded fluidic device having a power nozzle with a width W and a coupling passage coupling a source of fluid to said power nozzle. The coupling passage has a planar enlargement and a plurality of posts spaced across the enlargement, the spacing S between each post being less than the width of the power nozzle with the sum of spacing S being greater than the width W.

7 Claims, 6 Drawing Sheets

NOZZLES WITH INTEGRATED OR BUILT-IN FILTERS AND METHOD

REFERENCE TO RELATED APPLICATION

This application is the subject of provisional application Ser. No. 60/111,745 filed Dec. 10, 1998 and entitled FLUIDIC NOZZLES WITH INTEGRATED OR BUILT-IN FILTERS.

BACKGROUND AND BRIEF DESCRIPTION OF THE INVENTION

Fluidic oscillators as shown in FIG. 1 are well known and particularly useful in liquid spray applications such as washer nozzles. Such fluidic oscillators are typically manufactured of molded plastic and comprise a fluidic oscillator circuit OC or silhouette molded in a chip or insert 13 and a housing 10 having a cavity 11 into which the chip or insert 13 is forcibly inserted. A source of fluid under pressure is supplied to the power nozzle PN in the fluidic oscillator circuit OC by way of an inlet pipe or barb 12. Care is taken in the design to assure a seal between the housing internal surfaces and the mating surfaces of the chip or insert. In mass manufacturing of such chips and housing, small loose plastic particles can be carried by liquid flow and can clog portions of the fluidic circuit or outlet thereby blocking the flow of liquid (washer liquid in the case of a washer nozzle). In the case of fluidic oscillators, this interrupts the oscillation function.

There have been efforts to place screens or discrete filter screens upstream of the fluidic circuit, but these expedients add cost and complexity to the device. Thus, the problem solved and addressed by the present invention is potential clogging of liquid flow devices. The invention solves this problem by integrally providing extra places or enlargements and spaced posts for contaminants or loose particles to lodge or become trapped in areas other than main flow areas so that there are additional flow passages or ways for liquid to flow if a contaminant or particle blocks one or more passages or spaces between posts.

The invention provides for low profiles in areas specifically designed to encourage contaminants to flow into and stop in areas other than the power nozzle or the main jet flow area. By providing integral molded enlargements with spaced posts in areas as described above, the fluidic nozzle can continue to function in spite of partial upstream blockage in the enlargement area because a power jet channel is still completely open. In the absence of the present invention, contaminants usually flow directly into the power nozzle or the main jet area, thereby making the system nonfunctional.

The invention features a molded fluidic device having a power nozzle with a width W and a coupling passage coupling a source of fluid to said power nozzle. The coupling passage has an enlargement and a plurality of posts spaced across the enlargement, the spacing S between each post being less than the width of the power nozzle with the sum of spacings S being greater than the width W and the coupling passage and posts being integrally molded with the fluidic device. The dimensions of the coupling passage, the planar enlargement and the spacing S are such that the fluidic flow rate from the source to the power nozzle is substantially unaffected when a foreign particle blocks any one of the spaces between the posts. In a preferred embodiment, fluidic is a liquid oscillator which issues a fan spray of liquid droplets to ambient and wherein the dimensions of the planar enlargement and the spaces S are such that the fan spray is substantially unaffected when one or more foreign particles is trapped in any one or more of the spaces. The coupling passage and the posts are molded as an integral molding with the fluid device. A housing member into which the integral molding is inserted has a coupling to a source of liquid under pressure.

The invention has advantageous usage in molded liquid-spray nozzles, particularly when the liquid is sprayed to ambient; and still more particularly when the liquid is a wash liquid to be sprayed on a surface to be washed, such as vehicle glass.

Benefits of the present invention include the following:

1. Provides for prolonged life for the system in which the nozzle is used.
2. Provides a filter mechanism free of cost compared to in-line filters which require a separate component and some of which require a hose to be cut to include the filter, install the filter, etc.

DESCRIPTION OF THE DRAWINGS

The above and other objects, advantages and features of the invention will become more apparent when considered with the following specification and accompanying drawings, wherein.

DETAILED DESCRIPTION OF THE INVENTION

Figure 1:
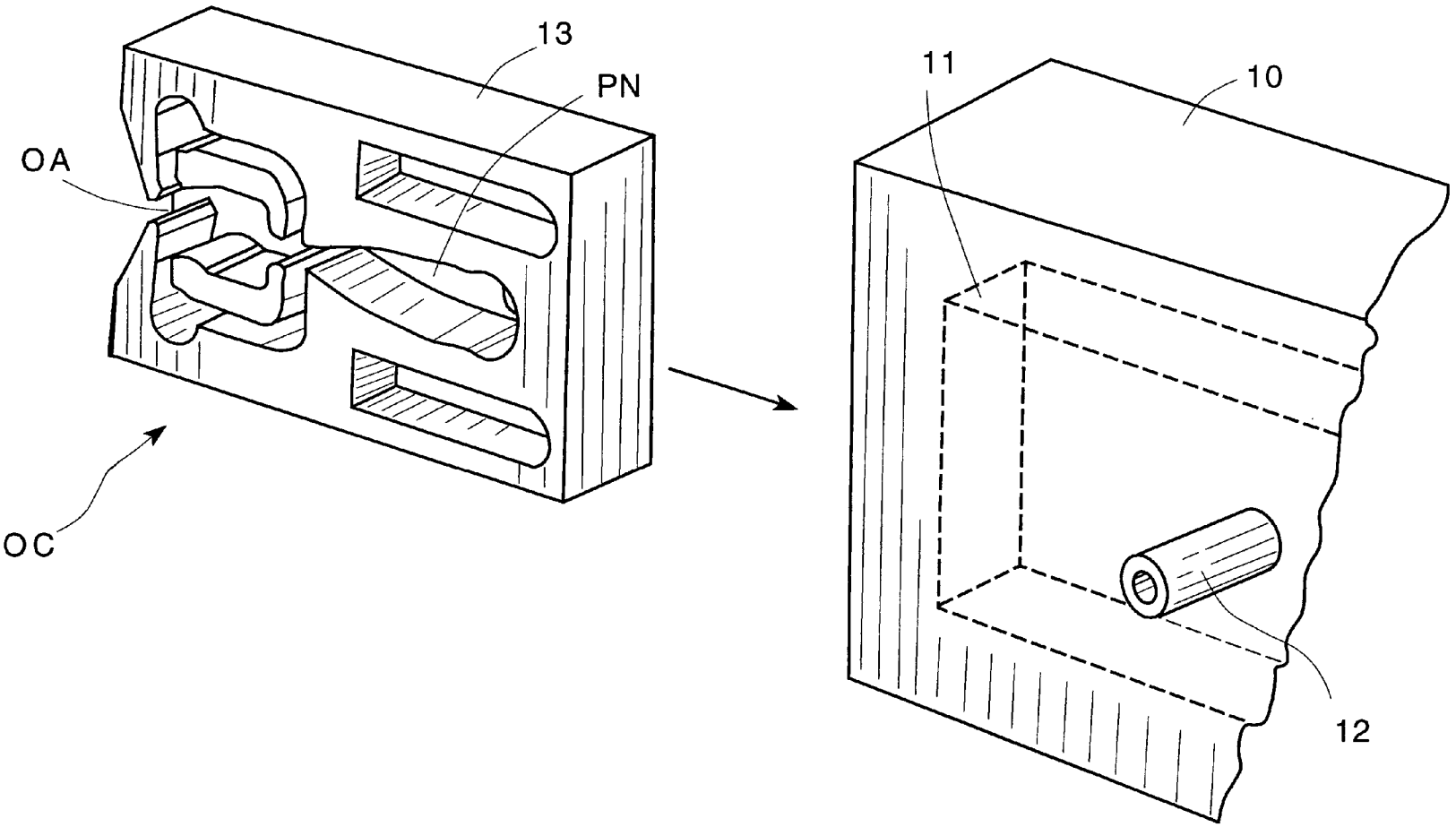
FIGURE 1 (PRIOR ART)
FIG. 1 is a diagrammatic exploded illustration of a prior art fluidic oscillator chip or insert and housing.
Figure 2A:
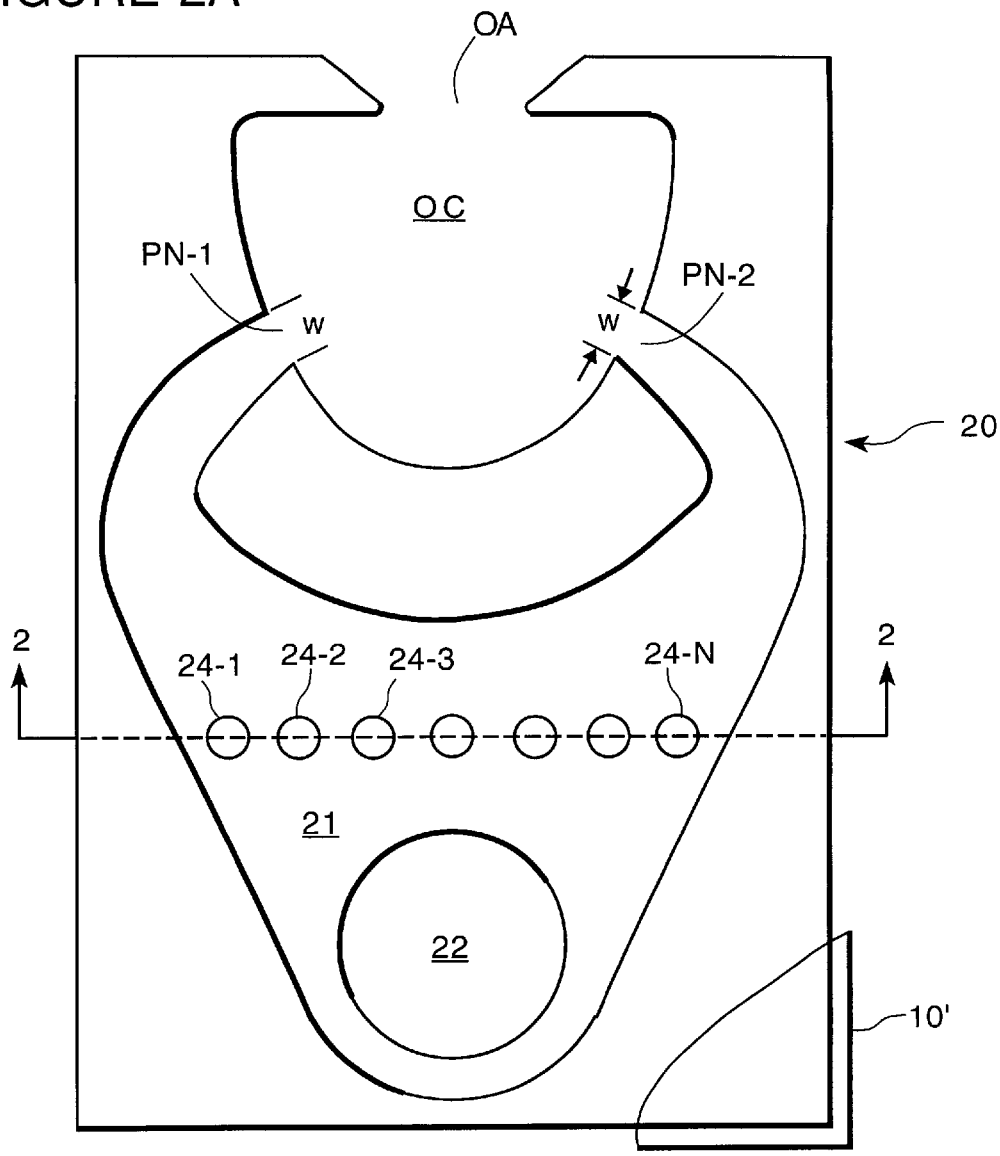
FIG. 2A is an illustration of a preferred embodiment of a fluidic oscillator incorporating the invention.
Figure 2B:
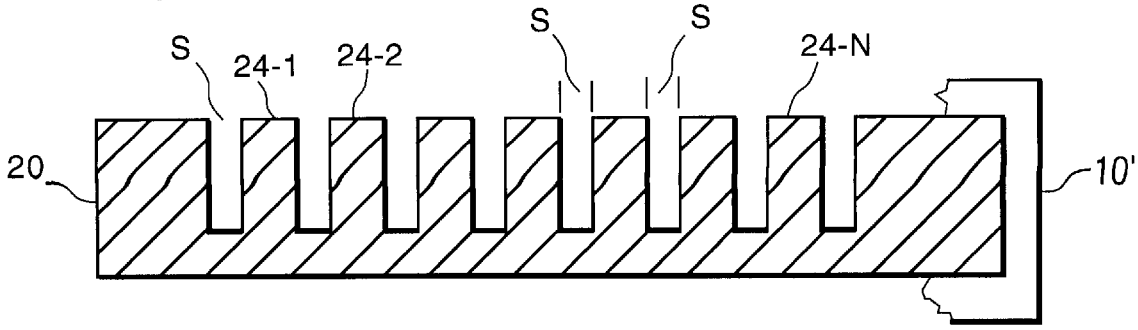
FIG. 2B is a section taken on lines 2—2 thereof.

Referring now to FIGS. 2A and 2B, the fluidic circuit is of a multiple power nozzle type oscillator 20 in which a pair of power nozzles PN1 and PN2 issue jets of fluid (preferably liquid) into an oscillation chamber OC in which a system of oscillating vortices is set up which issues a sweeping jet through an outlet aperture OA to ambient where the liquid jet breaks up into droplets. The fluid feed for the power nozzles PN1, PN2 is constituted by a planar passage 21 from a source of fluid 22. It will be noted that the passage 21 is a planar enlargement in the flow of fluid to the power nozzles PN1 and PN2. A portion of housing 10' is illustrated. (Various other embodiments of the fluidic oscillator element is disclosed in copending application Ser. No. 09/417,899 filed Oct. 14, 1999 and entitled FEEDBACK-FREE FLUIDIC OSCILLATOR AND METHOD.

Integrally molded with the body of the circuit elements are a plurality of posts or pillars 24-1, 24-2 . . . 24-N. The power nozzles PN1, PN2 each have a width W and the spacing S between the pillars or posts 24-1, 24-2 . . . 24-N need not be equal but preferably are equal and the spacing S between each post 24 is less than the width W of the power nozzle with the sum of the spacings S being greater than the width of the power nozzle W. As noted above, the enlargement is planar and essentially coplanar with the fluidic circuit element 20.

Figure 3A:
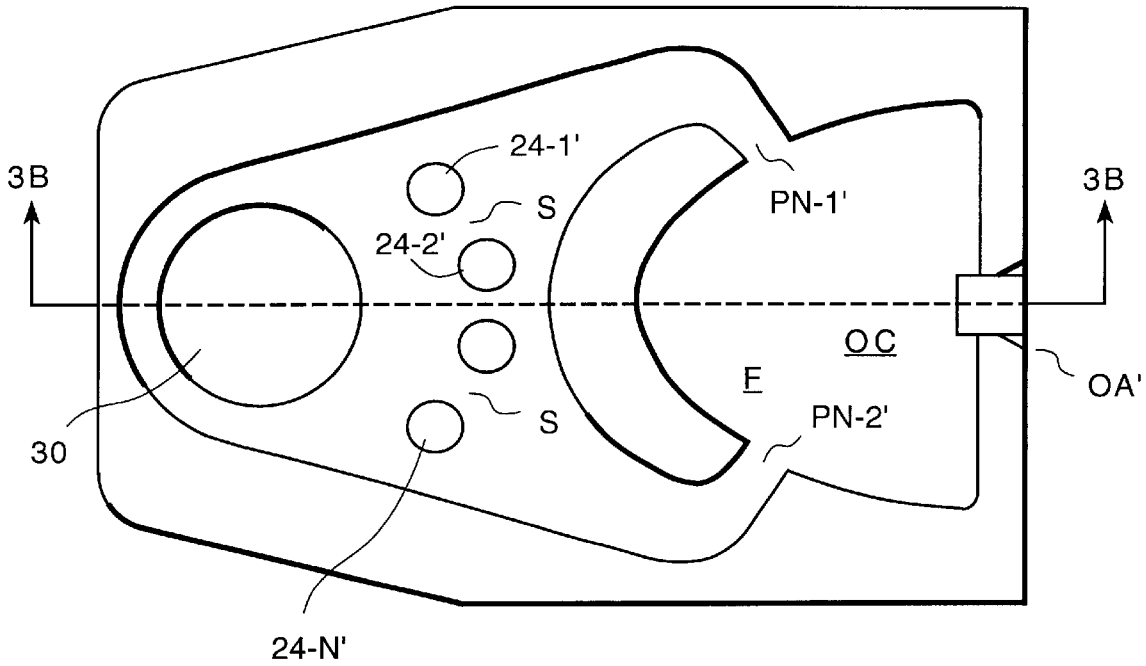
FIG. 3A is an illustration of a further embodiment of the invention.
Figure 3B:
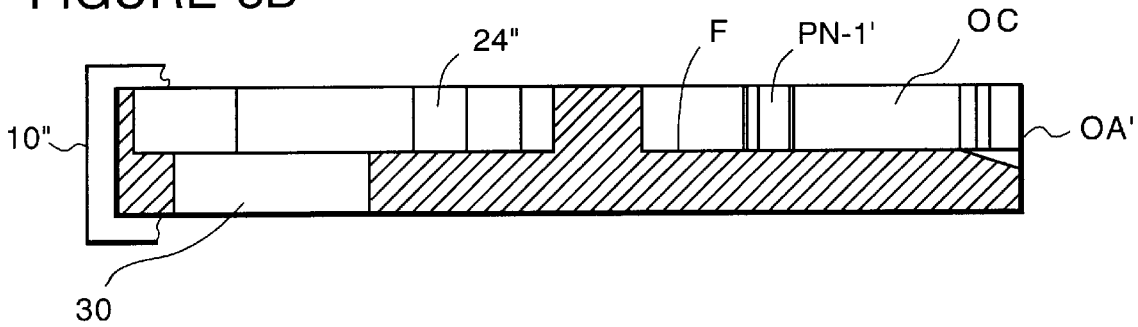
FIG. 3B is a sectional view taken on lines 3—3 thereof.

The embodiment shown in FIGS. 3A and 3B is essentially the same as the embodiment in FIG. 2 except that here the posts or pillars 24' are in an arc. In this embodiment, the floor F of the fluidic oscillator is flat up to the outlet OA' throat where there is a downward taper as shown in the sectional view (FIG. 3B). In this embodiment, the fluid flow is from the bottom of the element through aperture 30 as indicated in FIG. 3B, but it could be from the top. A portion of the housing is shown in FIG. 3B.

Figure 4:
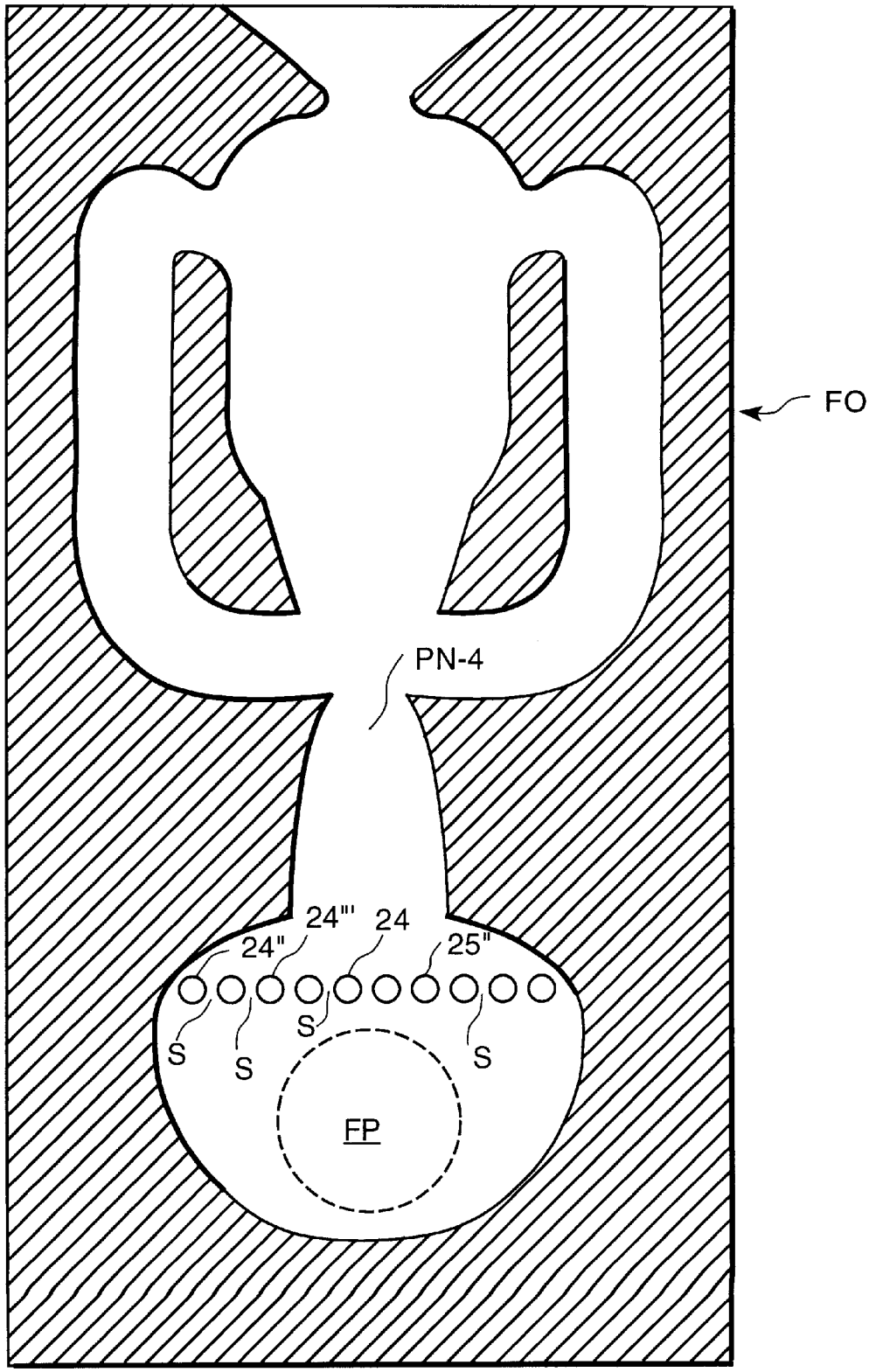
FIG. 4 is a drawing illustrating a built-in filter concept of the present invention as applied to a further type of fluidic oscillator.

In the embodiment shown in FIG. 4, a different fluidic oscillator FO is illustrated (this fluidic oscillator being of the type shown in Bray U.S. Pat. No. 4,463,904 issued Aug. 7, 1984 and U.S. Pat. No. 4,645,126 issued Feb. 24, 1987, incorporated by reference and having the cold performance feature thereof). Note that in this embodiment, the pillars or posts 24" are in a row, and the fluidic feed FF is in advance of or upstream of that row of pillars or posts 24".

Figure 5:
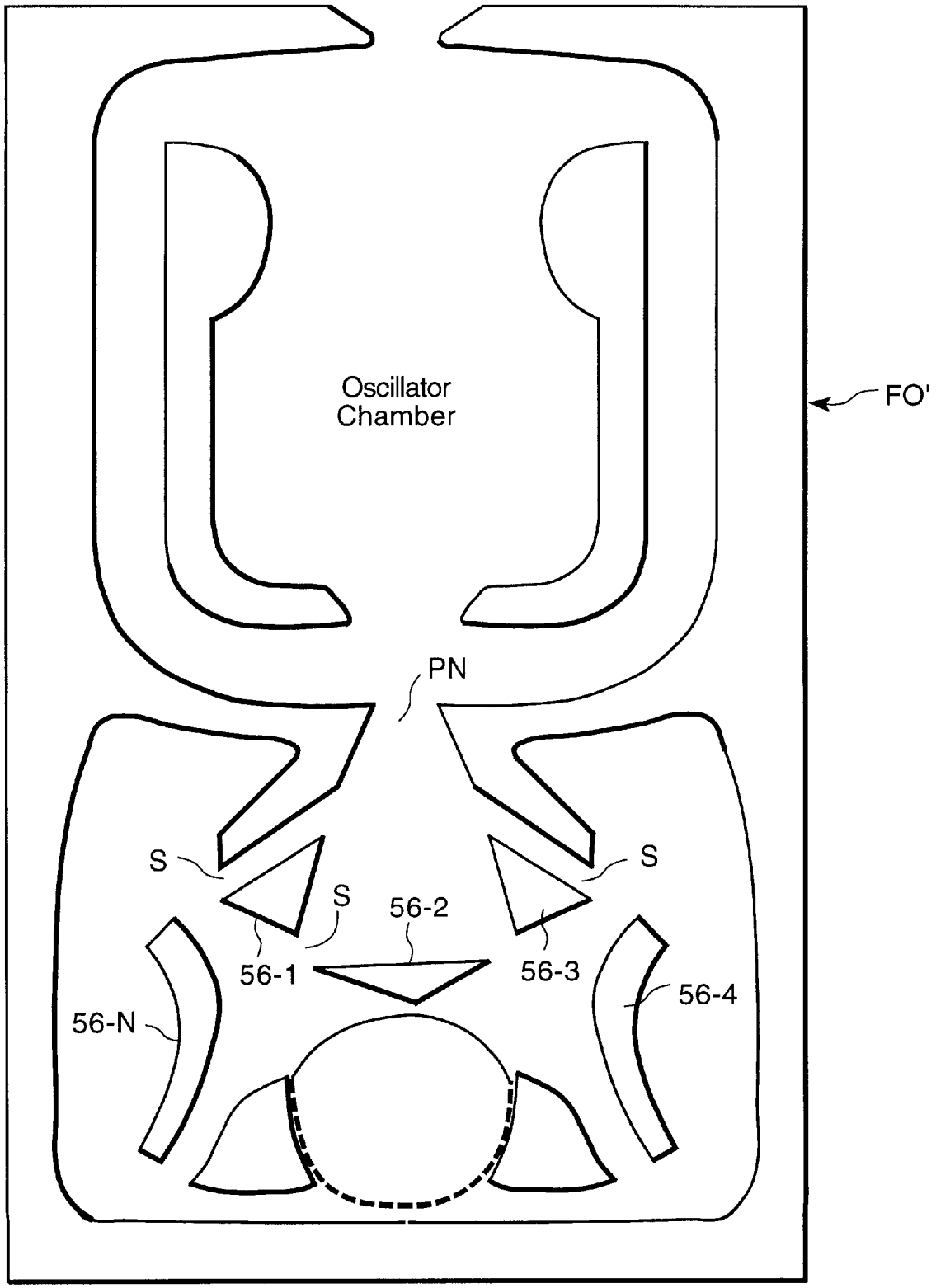
FIG. 5 is a further fluidic oscillator having a power nozzle incorporating the present invention, FIGS. 6A and 6B disclosure a circuit diagram of a further fluidic oscillator incorporating the invention; in this case, the two levels, FIG. 6B illustrating the flow to the power nozzle and FIG. 6A illustrating the fluidic oscillator itself with the input power nozzle flow and built-in filter illustrated in dotted lines in Figure B.

In the embodiment shown in FIG. 5, the pillars 56-1, 56-2 . . . 56-N or posts need not be circular, round or square; they can be of various shapes. In this embodiment, the fluidic oscillator FO' is of the type disclosed in Stouffer U.S. Pat. No. 4,508,267 issued Apr. 2, 1985, incorporated herein by reference. In each case, the various multiple passages between power nozzle or input for feed for liquid has a spacing S and the embodiment shown in FIG. 5, the spacings can be varied. All of the spacings S between the posts are less than the width W of the power nozzle with the sum of the spacings being greater than W so that the fluidic flow from the source to the power nozzle is substantially unaffected if a foreign particle blocks any one or more of the spaces S between the posts.

Figure 6A:
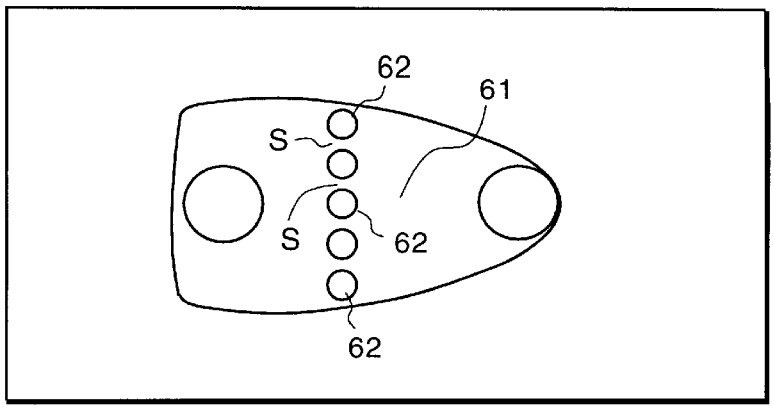
Figure 6B:
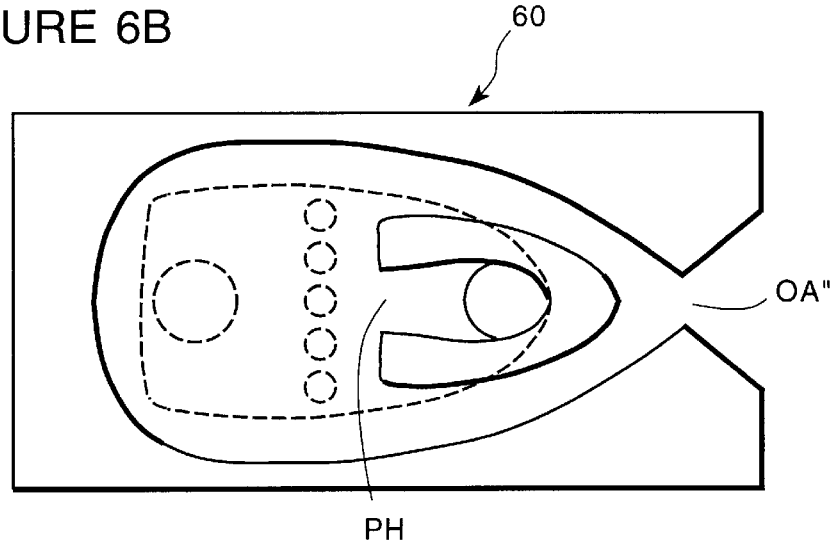

In the embodiment shown in FIGS. 6A and 6B, the fluidic oscillator is of the reversing chamber type as disclosed in Raghu patent application Ser. No. 09/427,985, filed Oct. 27, 1999 entitled REVERSING CHAMBER OSCILLATOR. In this embodiment, the fluidic insert 60 has two levels with the liquid or fluid coupling passage 61 and spaced posts 62 formed in the lower half shown in plan view in FIG. 6B.

Figure 7:
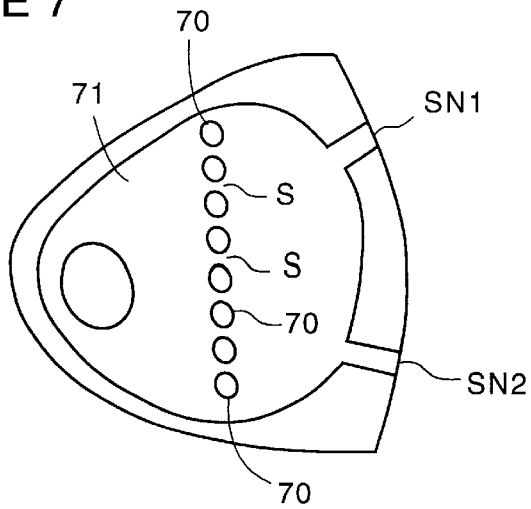
FIG. 7 is an illustration of a built-in filter according to the present invention in which the filter could be used in typical nonfluidic dual-jet-type windshield washer nozzle; the same use can be made for single and triple port nozzles of the same variety.

In the embodiment shown in FIG. 7, the integrated filter of this invention is shown as used in a typical nonfluidic dual type windshield washer nozzle. The same use can be made for a single and triple port nozzles of the same variety. In this case, the posts or pillars 70 in passage enlargement 71 are all in advance of the dual spraying nozzles SN-1, SN-2.

While the invention has been described in relation to preferred embodiments of the invention, it will be appreciated that other embodiments, adaptations and modifications of the invention will be apparent to those skilled in the art.

What is claimed is:

1. In a molded fluidic spray device having a power nozzle with a width W and a coupling passage coupling a source of liquid under pressure to said power nozzle, the improvement wherein said fluidic device includes a molded fluidic circuit and a housing having a cavity into which said molded fluidic circuit is forcibly inserted and wherein said coupling passage has an enlargement and a plurality of posts spaced across said enlargement, the spacing S between each post being less than the width of said power nozzle with the sum of spacing S being substantially greater than said width W and wherein said enlargement is planar and the dimensions of said coupling passage, said planar enlargement and said spacing S are such that the fluid flow rate from said source to said power nozzle is substantially unaffected when one or more foreign particles block any one or more of said spaces between said posts.

2. The molded fluid device defined in claim 1 wherein said spacing S between posts is substantially uniform.

3. In a molded fluidic spray device having a power nozzle with a width W and a coupling passage coupling a source of liquid under pressure to said power nozzle, the improvement wherein said coupling passage has a planar enlargement and a plurality of posts spaced across said planar enlargement, the space S between each post being less than the width of said power nozzle with the sum of spacing S being substantially greater than said width W and wherein said device includes a planar fluidic oscillator and wherein said enlargement is coplanar with said planar fluidic oscillator and the dimensions of said coupling passage, said planar enlargement and all said spacings S are such that the fluidic flow rate from said source to said power nozzle is substantially unaffected when one or more foreign particles obstructs any one of or more of said spaces.

4. In a molded fluidic spray device having a power nozzle with a width W and a coupling passage coupling a source of liquid under pressure to said power nozzle, the improvement wherein said coupling passage has an enlargement and a plurality of posts spaced across said enlargement, the space S between each post being less than the width of said power nozzle with the sum of spacing S being substantially greater than said width W, wherein said device includes a planar fluidic oscillator, wherein said fluid is a liquid and said fluidic oscillator issues a fan spray of said liquid droplets to ambient and wherein the dimensions of said planar enlargement and said spaces S are such that said fan spray is substantially unaffected when one or more foreign particles is trapped in any one or more of said spaces.

5. The molded fluidic device defined in claim 4 wherein said fluidic oscillator, said coupling passage and said posts are injection-molded as an integral molding, and a housing member into which said integral molding is inserted.

6. In a liquid dispensing fluidic nozzle having a molded housing and an injection-molded fluidic circuit insert adapted to be forced into said housing, said fluidic circuit insert having a liquid dispensing outlet at a downstream end thereof, one or more power nozzles at an upstream end thereof and a liquid flow passage formed in a surface of said insert and adapted to be coupled to said one or more power nozzles coupled to a source of liquid under pressure, the improvement comprising:

an enlargement in said liquid flow passage and a plurality of spaced posts dividing said enlargement in said liquid flow passage into a plurality N of smaller flow spaces with the size of said enlargement and the size of spacing between said posts being such as to trap loose particles carried in liquid flowing through said liquid flow passage without affecting the flow rate to said power nozzles.

7. The method of providing a filter in an injection-molded fluidic circuit having at least one power nozzle having a width W and a coupling passage adapted to connect at least one power nozzle in said fluidic circuit to a source of liquid under pressure comprising injection-molding an enlargement in said coupling passage with a plurality of spaced posts in said enlargement with the spacing S between the posts being less than the width W of said power nozzle and the sum of all said spacings S being significantly greater than W so as to trap loose particles without affecting the flow rate between said at least one power nozzle and said source of liquid under pressure, inserting said fluidic circuit in a cavity in a molded housing having one wall of said coupling passage thereby completing said filter.

* * * * *